US010830110B2

(12) United States Patent
Tada

(10) Patent No.: US 10,830,110 B2
(45) Date of Patent: Nov. 10, 2020

(54) VALVE TIMING ADJUSTMENT DEVICE

(71) Applicant: DENSO CORPORATION, Kariya (JP)

(72) Inventor: Kenji Tada, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/092,583

(22) PCT Filed: Feb. 28, 2017

(86) PCT No.: PCT/JP2017/007584
§ 371 (c)(1),
(2) Date: Oct. 10, 2018

(87) PCT Pub. No.: WO2017/179322
PCT Pub. Date: Oct. 19, 2017

(65) Prior Publication Data

US 2019/0120091 A1 Apr. 25, 2019

(30) Foreign Application Priority Data

Apr. 14, 2016 (JP) ..... 2016-081459

(51) Int. Cl.
*F01L 1/344* (2006.01)
*F01L 1/352* (2006.01)

(52) U.S. Cl.
CPC ..... *F01L 1/34409* (2013.01); *F01L 1/352* (2013.01)

(58) Field of Classification Search
CPC ..... F01L 1/34409; F01L 1/352; F01L 1/344; F01L 1/34; F01L 1/026; F01L 1/022
USPC ..... 123/90.15, 90.16, 90.17
See application file for complete search history.

(56) References Cited

U.S. PATENT DOCUMENTS 7,959,537 B2 * 6/2011 Sugiura ..... F01L 1/34 477/176
8,076,899 B2 * 12/2011 Uehama ..... F01L 1/352 318/809
2007/0101961 A1 * 5/2007 Teraya ..... F02D 41/06 123/90.17
2007/0199531 A1 8/2007 Sugiura et al.
2008/0083384 A1 * 4/2008 Morii ..... F01L 1/356 123/90.15

(Continued)

FOREIGN PATENT DOCUMENTS

JP 2015-040509 3/2015
JP 2015040509 A * 3/2015

*Primary Examiner* — Devon C Kramer
*Assistant Examiner* — Kelsey L Stanek
(74) *Attorney, Agent, or Firm* — Nixon & Vanderhye P.C.

(57) ABSTRACT

A driven rotational body rotates relative to a driving rotational body to change a rotational phase therebetween and brings its driven-side stopper wall into contact with a driving-side stopper wall of the driving rotational body in the relative rotational direction. The planetary gear performs a planetary motion while being meshed with the driving rotational body and the driven rotational body to change the rotational phase. The driving rotational body includes a gear member, a cover member, and a fastening member. The gear member has the driving-side stopper wall and is meshed with the planetary gear. The cover member covers an accommodation space, in which the driven rotational body and the planetary gear are accommodated, together with the gear member. The fastening member axially fastens the gear member with the cover member.

5 Claims, 13 Drawing Sheets

(56) References Cited

U.S. PATENT DOCUMENTS

| | | | | |
|---|---|---|---|---|
| 2015/0075462 | A1 | 3/2015 | Kurisu | |
| 2015/0211392 | A1 | 7/2015 | Otsubo et al. | |
| 2016/0024977 | A1* | 1/2016 | Takahashi ..... | F01L 1/352<br>123/90.15 |

* cited by examiner

VALVE TIMING ADJUSTMENT DEVICE

CROSS REFERENCE TO RELATED APPLICATION

This application is the U.S. national phase of International Application PCT/JP2017/007584 filed Feb. 28, 2017, which designated the U.S. and claims priority to Japanese Patent Application No. 2016-81459 filed on Apr. 14, 2016, the entire contents of each of which are hereby incorporated herein by reference.

TECHNICAL FIELD

The present disclosure relates to a valve timing adjustment device configured to adjust a valve timing of a movable valve, which is configured to be opened and closed with a camshaft by transmission of a crank torque from a crankshaft in an internal combustion engine.

BACKGROUND ART

A known valve timing adjustment device is configured to change a rotational phase between a driving rotational body and a driven rotational body, which respectively rotate in conjunction with a crankshaft and a camshaft, thereby to change a relative rotation of those rotational bodies.

In a device of Patent Literature 1 as a type of such a valve timing adjustment device, a planetary gear is meshed with a driving rotational body and a driven rotational body to perform a planetary motion, thereby to change the rotational phase between the driving rotational body and the driven rotational body. In the configuration, a driving-side stopper wall and a driven-side stopper wall of the respective driving rotational body and the driven rotational body alternately come into contact with each other to regulate the change in rotational phase.

In the device of Patent Literature 1, a gear member and a cover member are axially fastened with a screw, which is a fastening member, to form the driving rotational body. In the present configuration, the gear member and the cover member cooperate with each other to form an accommodation space for accommodating the driven rotational body and the planetary gear.

In the device of Patent Literature 1, the cover member has the driving-side stopper wall, and the gear member is meshed with the planetary gear. Hence, the driven-side stopper wall of the driven rotational body collides against the driving-side stopper wall of the cover member to cause a collision torque. Due to the collision torque, the durability and quietness of the device may be reduced.

PRIOR TECHNICAL LITERATURE

Patent Literature

PATENT LITERATURE 1: JP 2007-255412 A

SUMMARY OF INVENTION

In the device of Patent Literature 1, the cover member has the driving-side stopper wall, and the gear member is meshed with the planetary gear. Hence, the driven-side stopper wall of the driven rotational body collides against the driving-side stopper wall of the cover member to cause a collision torque. This collision torque is transmitted from the driven rotational body to the planetary gear, and further transmitted from the planetary gear to the gear member. Consequently, relative torque acts between the gear member and the cover member. As a result, the fastening member that axially fastens the gear member with the cover member may be easily loosened, so that wear and unusual noise may arise at the meshing portion between the gear member tilted due to the looseness and the planetary gear. On the other hand, when the fastening torque caused by the fastening member is previously increased for inhibiting such looseness of the fastening member, the gear member may be easily strained, and also due to this strain, wear and unusual noise may arise at the meshing portion between the gear member and the planetary gear.

In particular, in the device of Patent Literature 1 in which the screw as the fastening member eccentric from the rotational center line of the driving rotational body axially fastens the gear member with the cover member, the relative torque acts between the gear member and the cover member, and hence an arc sliding phenomenon may appear on the bearing surface of the screw in contact with the gear member. Specifically, on a bearing surface A of a screw shown in FIG. 14, the direction of the acted torque is different between two regions A1, A2 that sandwich a pair of arcs Cva of a virtual circuit Cv assumed passing through a rotational center line O of the driving rotational body and an axis S of the screw around a middle point P of those lines O, S. As a result, when the relative torque between the gear member and the cover member increases, the screw is loosened if a difference in acted torque between the regions A1, A2 exceeds the fastening torque caused by the screw. In view of this, it is desirable to improve the deterioration in durability and quietness caused by generation of the wear and unusual noise at the meshing portion between the gear member and the planetary gear.

It is an object of the present disclosure to provide a valve timing adjustment device configured to enhance durability and quietness.

According to one aspect of the present disclosure, a valve timing adjustment device is configured to adjust a valve timing of a movable valve. The movable valve is configured to be opened and closed with a camshaft by transmission of a crank torque from a crankshaft in an internal combustion engine. The valve timing adjustment device comprises a driving rotational body including a driving-side stopper wall and configured to rotate in conjunction with the crankshaft. The valve timing adjustment device further comprises a driven rotational body including a driven-side stopper wall. The driven rotational body is configured to rotate relative to the driving rotational body while rotating in conjunction with the camshaft to change a rotational phase relative to the driving rotational body and to bring the driven-side stopper wall and the driving-side stopper wall into contact with each other in a relative rotational direction to the driving rotational body to regulate a change in the rotational phase. The valve timing adjustment device further comprises a planetary gear configured to perform a planetary motion while being meshed with the driving rotational body and the driven rotational body to change the rotational phase. The driving rotational body includes a gear member having the driving-side stopper wall and meshed with the planetary gear. The driving rotational body further includes a cover member covering an accommodation space, in which the driven rotational body and the planetary gear are accommodated, in cooperation with the gear member. The driving rotational body further includes a fastening member axially fastening the gear member with the cover member.

BRIEF DESCRIPTION OF THE DRAWINGS

The above and other objects, features and advantages of the present disclosure will become more apparent from the following detailed description made with reference to the accompanying drawings. In the drawings.

DESCRIPTION OF EMBODIMENTS

Figure 1:
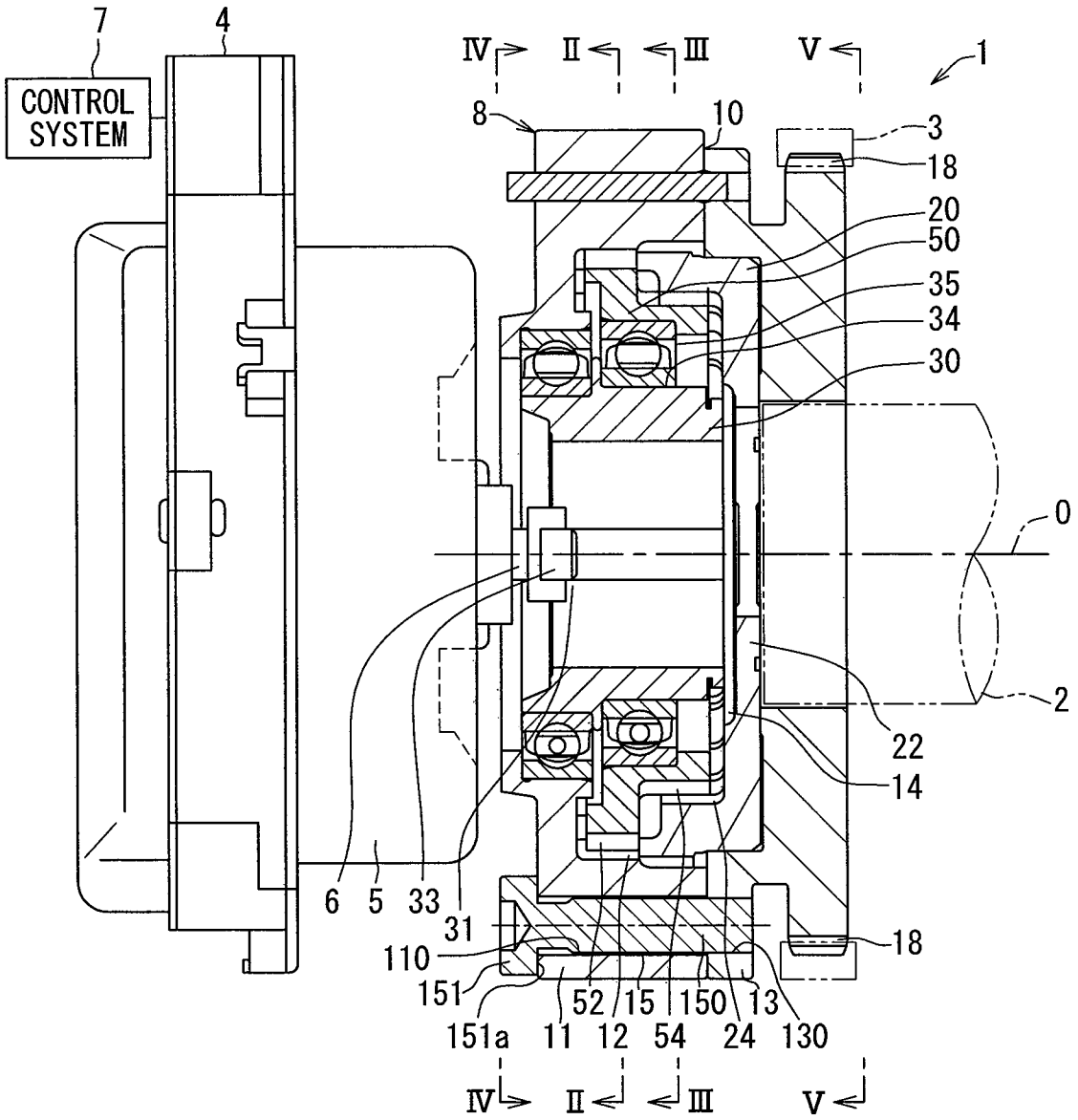
FIG. 1 is a view showing a valve timing adjustment device according to a first embodiment, FIG. 1 being a sectional view taken along a line I-I in FIG. 2.

Hereinafter, a plurality of embodiments of the present disclosure will be described with reference to the drawings. It is to be noted that the same reference numerals are attached to the corresponding constituent elements in each embodiment, and redundant description may be omitted. In a case where only a part of the configuration is described in each embodiment, the configuration of the other embodiment described above can be applied to the other parts of the configuration. Further, not only the configurations specified in the description of each embodiment can be combined but also configurations of a plurality of embodiments can be partially combined even if not specified, especially if combinations do not cause issues.

First Embodiment

As shown in FIG. 1, a valve timing adjustment device 1 according to a first embodiment of the present disclosure is installed in a transmission system that transmits crank torque from a crankshaft (not shown) of an internal combustion engine to a camshaft 2 in a vehicle. Herein, the camshaft 2 is an axis for opening and closing an intake valve (not shown) of a movable valve in the internal combustion engine by transmission of the crank torque. In order to adjust the valve timing of the intake valve, the valve timing adjustment device 1 includes an electric motor 4, a control system 7, a phase adjustment system 8, and the like.

The electric motor 4 is, for example, a brushless motor or the like, and includes a motor case 5 fixed to a fixed node of the internal combustion engine and a motor shaft 6 supported by the case 5 so as to freely rotate forward and backward. The control system 7 is made up of a driving unit and a microcomputer for controlling the driving unit, and is located outside and/or inside the motor case 5 to be electrically connected to the electric motor 4. The control system 7 controls energization of the electric motor 4 to generate a motor torque thereby to rotationally drive the motor shaft 6.

As shown in FIGS. 1 to 5, the phase adjustment system 8 includes a driving rotational body 10, a driven rotational body 20, a planetary carrier 30, and a planetary gear 50.

Figure 2:
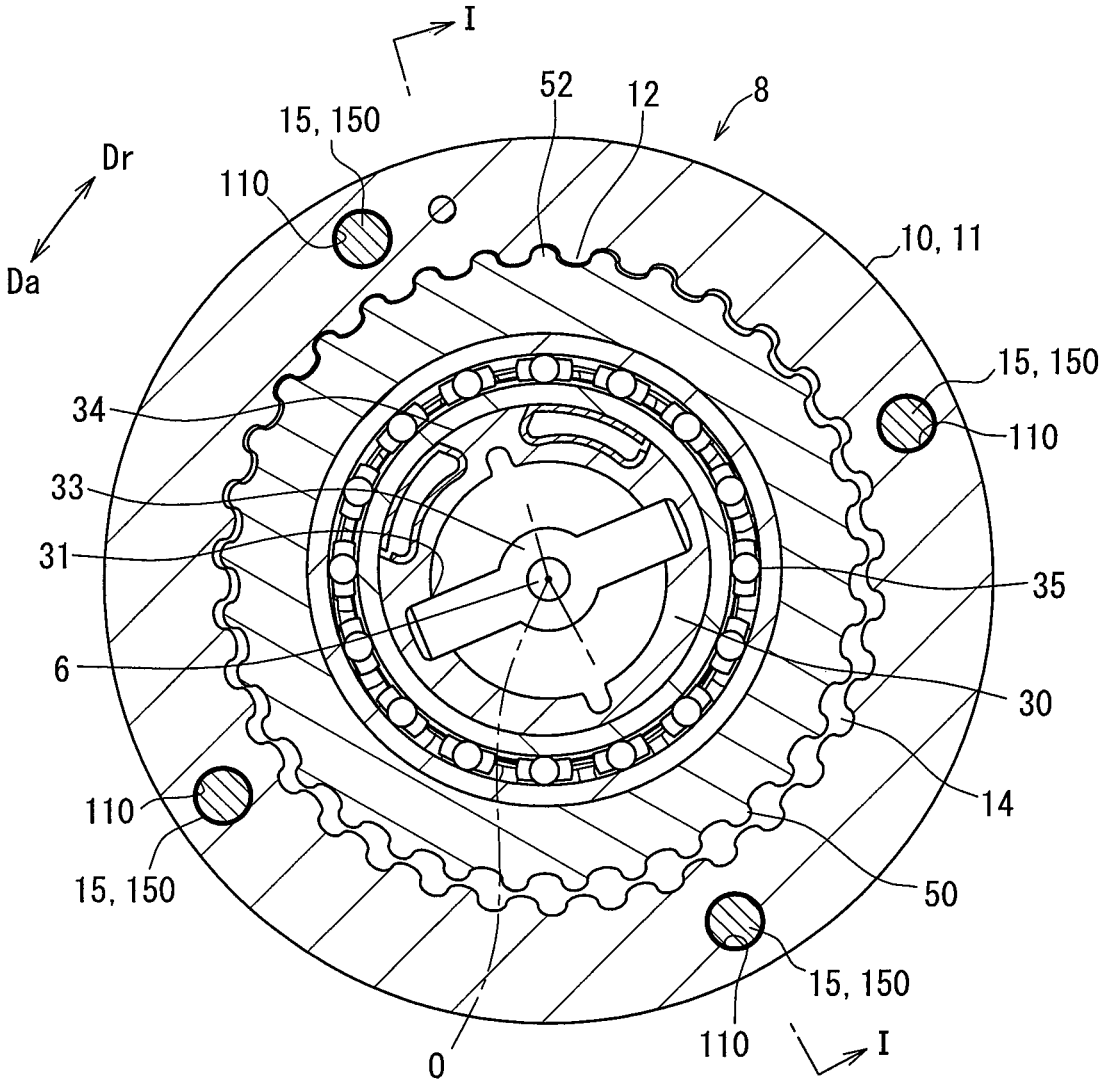
FIG. 2 is a sectional view taken along a line II-II in FIG. 1.
Figure 3:
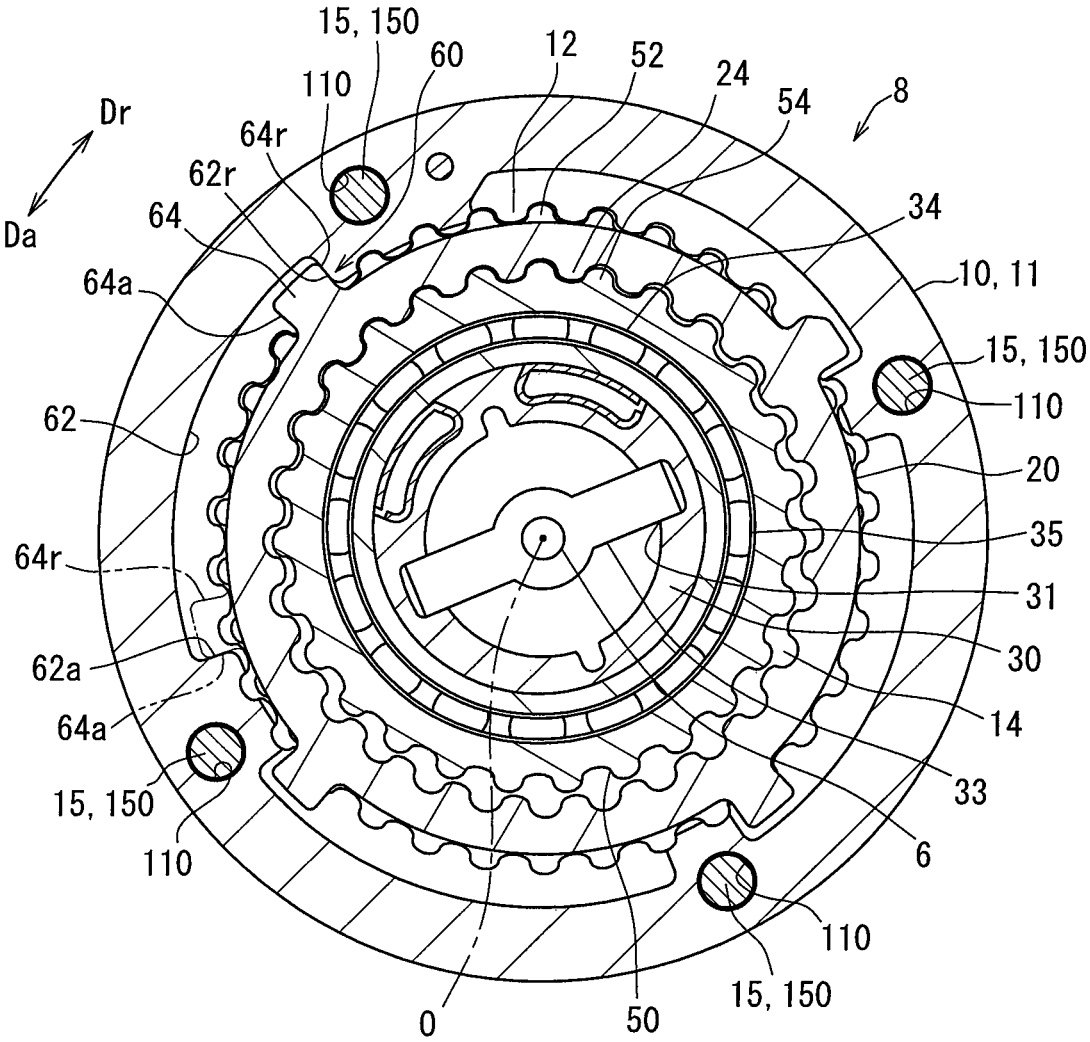
FIG. 3 is a sectional view taken along a line III-III in FIG. 1.

The driving rotational body 10 includes a gear member 11, a cover member 13, and a plurality of fastening members 15 that coaxially fastens the two members 11, 13 with each other. The gear member 11 is formed in a cylindrical shape of a metallic material. As shown in FIGS. 1 to 3, the gear member 11 has a driving-side internal gear portion 12 in which a tooth top circle is set on the inner circumferential side of a tooth bottom circle. Herein, a cycloid gear is employed as the driving-side internal gear portion 12 of the present embodiment.

Figure 5:
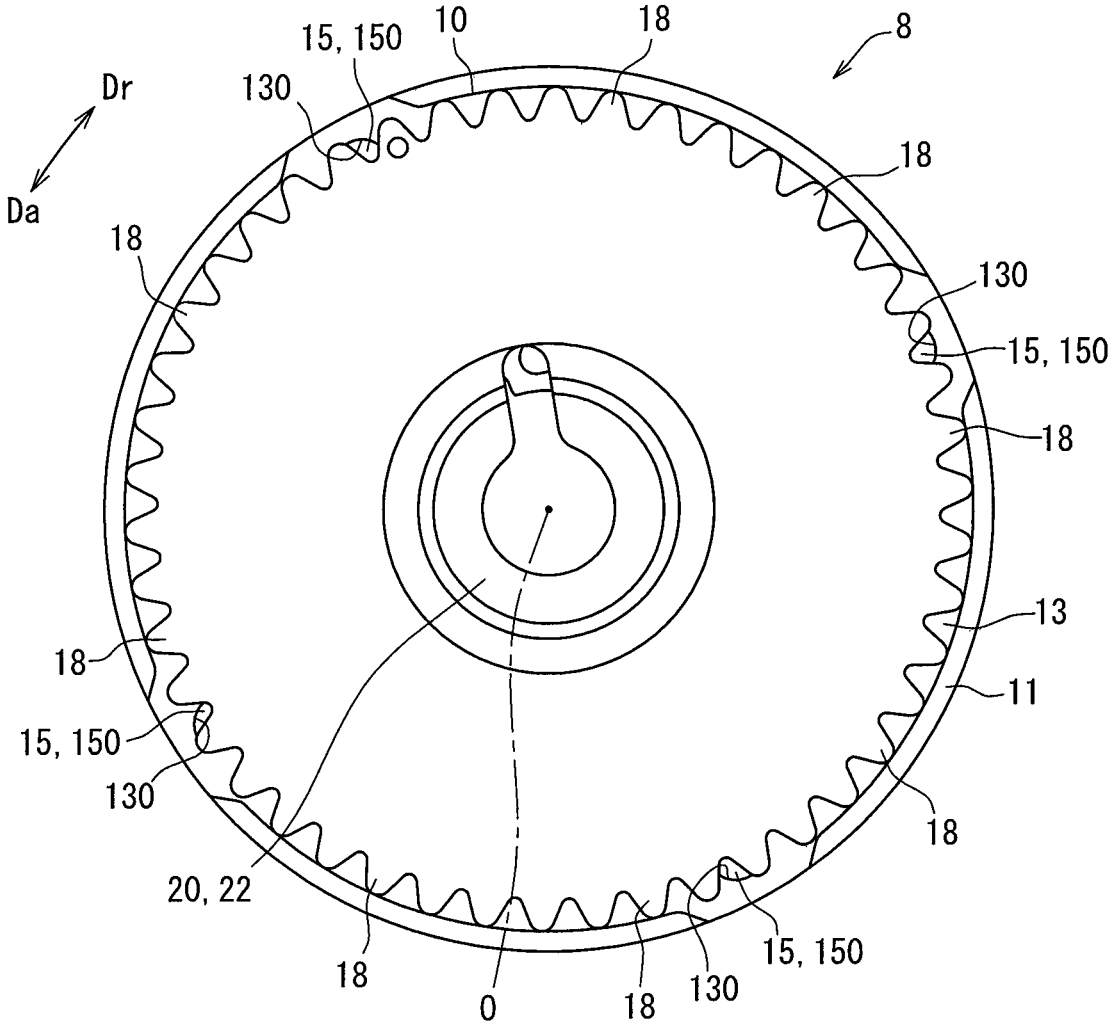
FIG. 5 is an arrow view taken along a line V-V in FIG. 1.

As shown in FIGS. 1 and 5, the cover member 13 is formed of a metallic material into an annular plate shape. The cover member 13 is located on the side opposite of the gear member 11 from the electric motor 4, and the gear member 11 is axially interposed therebetween. The cover member 13 forms a plurality of sprocket teeth 18 that protrude outward from positions circumferentially spaced at regular intervals. The cover member 13 is linked to the crankshaft via a transmission member 3, such as a timing chain, bridging between the sprocket teeth 18 and the plurality of teeth of the crankshaft. Under such a linked state, the crank torque of the crankshaft is transmitted to the cover member 13 through the transmission member 3, whereby the driving rotational body 10 rotates around the rotational center line O in conjunction with the crankshaft. Herein, the rotational direction of the driving rotational body 10 is circumferentially one side (i.e., counterclockwise direction in FIGS. 2 and 3).

As shown in FIGS. 1 to 5, each fastening member 15 is a screw formed of a metallic material. Each fastening member 15 is located at a position eccentric from the rotational center line O of the driving rotational body 10, and the fastening members 15 are located at positions at a regular interval circumferentially on the driving rotational body 10. That is, each fastening member 15 is located substantially in parallel along the rotational center line Of, and the fastening members 15 are located at positions at a regular interval around the rotational center line O. Further, each fastening member 15 of the present embodiment is located so as to be axially shifted from a forming position of the sprocket teeth 18 on the electric motor 4 side in the driving rotational body 10.

Each fastening member 15 includes a male screw portion 150 and a head 151 which are integrally formed with each other. Herein, the male screw portion 150 is loosely inserted in a through hole 110 axially extending through the gear member 11. The male screw portion 150 is further screwed in a female screw hole 130 axially extending through the cover member 13. A bearing surface 151*a* shown in FIG. 1 is formed on the head 151 so as to sandwich the gear member 11 with the cover member 13 screwed with the male screw portion 150.

The gear member 11 and the cover member 13, which are axially fastened with the fastening members 15, cover the accommodation space 14 in cooperation with each other as shown in FIGS. 1 to 3. In this accommodation space 14, the components 20, 30, 50 other than the driving rotational body 10 in the phase adjustment system 8 are accommodated.

Figure 4:
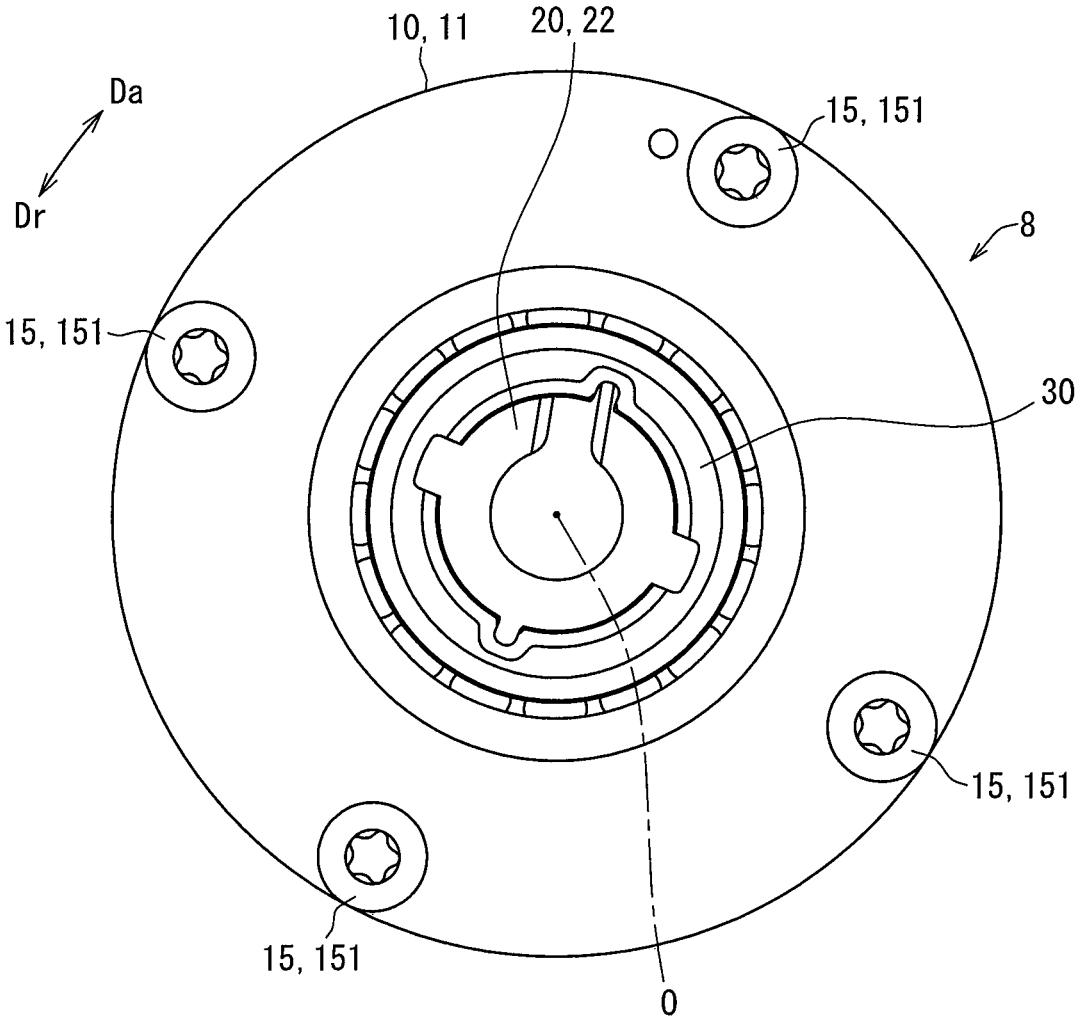
FIG. 4 is an arrow view taken along a line IV-IV in FIG. 1.

As shown in FIGS. 1 and 3 to 5, the driven rotational body 20 is formed in a bottomed cylindrical shape of a metallic material. The driven rotational body 20 is coaxially fitted to the inner circumferential side of the cover member 13. In the driven rotational body 20, a coupling portion 22 that is coaxially coupled to the camshaft 2 is formed in the bottom wall portion as shown in FIGS. 1, 4, and 5. Under such a coupled state, the driven rotational body 20 rotates around the rotational center line O in conjunction with the camshaft 2 by transmission of the crank torque. At this time, the driven rotational body 20 is enabled to rotate relative to the driving rotational body 10 by the transmission of the motor torque. Herein, the rotational direction of the driven rotational body 20 coincident with the rotational direction of the camshaft 2 is one side in the same circumferential direction as the rotational direction of the driving rotational body 10 (i.e., counterclockwise direction in FIG. 3). Further, as shown in FIGS. 3 to 5, the relative rotational direction of the driven rotational body 20 with respect to the driving rotational body 10 is an advanced-angle direction Da in which the rotation is advanced toward circumferentially one side and a retarded-angle direction Dr in which the rotation is retarded toward circumferentially the other side.

As shown in FIGS. 1 and 3, in the driven rotational body 20, a driven-side internal gear portion 24 having a tooth top circle set on the inner circumferential side of the tooth bottom circle is formed in the circumferential wall portion. Herein, a cycloid gear is employed as the driven-side internal gear portion 24 of the present embodiment. The number of teeth of the driven-side internal gear portion 24 is set to be smaller than the number of teeth of the driving-side internal gear portion 12. The driven-side internal gear portion 24 is axially shifted toward the camshaft 2 with respect to the driving-side internal gear portion 12.

As shown in FIGS. 1 to 4, the planetary carrier 30 is formed in a partially eccentric cylindrical shape of a metallic material. The planetary carrier 30 is located in an axial range extending from the inner circumferential side of the driven rotational body 20 to the inner circumferential side of the gear member 11 in the accommodation space 14. As shown in FIGS. 1 to 3, the planetary carrier 30 forms an input portion 31 with a cylindrical inner circumferential surface coaxial with the rotational bodies 10, 20 and the motor shaft 6. The input portion 31 is coupled to the motor shaft 6 so as to be rotatable together via the coupling joint 33. Under such a coupled state, the planetary carrier 30 rotates around the rotational center line O in conjunction with the motor shaft 6 by transmission of the motor torque, while the planetary carrier 30 is enabled to rotate relative to the driving-side internal gear portion 12 of the driving rotational body 10. Herein, the rotational direction of the planetary carrier 30 coincident with the rotational direction of the motor shaft 6 is either a forward rotational direction (i.e., the counterclockwise direction in FIGS. 2 and 3) which is circumferentially one side or a reverse rotational direction (i.e., the clockwise direction in FIGS. 2 and 3) which is circumferentially another side, in accordance with the motor torque. As shown in FIGS. 2 and 3, the relative rotational direction of the planetary carrier 30 with respect to the driving-side internal gear portion 12 is an advanced-angle direction Da in which the rotation is advanced toward circumferentially one side and a retarded-angle direction Dr in which the rotation is retarded toward circumferentially another side.

The planetary carrier 30 shown in FIGS. 1 to 3 further forms a support portion 34 with a cylindrical outer circumferential surface eccentric from the rotational bodies 10, 20 and the motor shaft 6. The support portion 34 is coaxially fitted to the inner circumferential side of the planetary gear 50 via the planetary bearing 35. The planetary gear 50 in such a fitted state is radially supported by the support portion 34 so that the planetary gear 50 is enabled to perform a planetary motion with the relative rotation of the planetary carrier 30 with respect to the driving-side internal gear portion 12. Herein, the planetary motion represents a motion in which the planetary gear 50 revolves in the forward or reverse rotational direction of the planetary carrier 30 while rotating.

The planetary gear 50 is formed in a stepped cylindrical shape of a metallic material. The planetary gear 50 is located in an axial range extending from the inner circumferential side of the driven rotational body 20 to the inner circumferential side of the gear member 11 in the accommodation space 14. The planetary gear 50 has a driving-side external gear portion 52 and a driven-side external gear portion 54 in which a tooth top circle is set on the outer circumference side of the tooth bottom circle. Herein, a cycloid gear is employed as the driving-side external gear portion 52 and the driven-side external gear portion 54 of the present embodiment. The numbers of teeth of the driving-side external gear portion 52 and the driven-side external gear portion 54 are respectively set to be smaller by the same numbers than the numbers of teeth of the driving-side internal gear portion 12 and the driven-side internal gear portion 24. The driving-side external gear portion 52 is located eccentrically on the inner circumferential side of the gear member 11 and is capable to perform a planetary motion while being meshed with the driving-side internal gear portion 12. The driven-side external gear portion 54 is axially shifted toward the camshaft 2 with respect to the driving-side external gear portion 52. As shown in FIGS. 1 and 3, the driven-side external gear portion 54 is located eccentrically on the inner circumferential side of the driven rotational body 20, and is capable to perform a planetary motion while being meshed with the driven-side internal gear portion 24.

With the above configuration, in the phase adjustment system 8 in which the rotational bodies 10, 20 are linked by gears, the rotational phase between the driving rotational body 10 and the driven rotational body 20 (hereinafter simply referred to as rotational phase) is determined in accordance with the motor torque controlled by the control system 7. The valve timing of the intake valve is adapted to the operating condition of the internal combustion engine by following such a rotational phase.

Specifically, when the planetary carrier 30 rotates forward with the motor shaft 6 at the same speed as the driving rotational body 10, the planetary carrier 30 does not rotate relative to the driving-side internal gear portion 12. As a result, the planetary gear 50 does not perform a planetary motion but rotates together with the rotational bodies 10, 20, so that the rotational phase is substantially unchanged and the valve timing is thus held and adjusted. Meanwhile, when the planetary carrier 30 rotates forward together with the motor shaft 6 at a higher speed than the driving rotational body 10, the planetary carrier 30 relatively rotates in the advanced-angle direction Da with respect to the driving-side internal gear portion 12. As a result, the planetary motion of the planetary gear 50 causes relative rotation of the driven rotational body 20 in the advanced-angle direction Da with respect to the driving rotational body 10, so that the rotational phase is advanced and the valve timing is advanced and adjusted. On the other hand, when the planetary carrier 30 rotates forward or backward at a lower speed than the driving rotational body 10 together with the motor shaft 6, the planetary carrier 30 relatively rotates in the retarded-angle direction Dr with respect to the driving-side internal gear portion 12. As a result, the planetary motion of the planetary gear 50 causes relative rotation of the driven rotational body 20 in the retarded-angle direction Dr with respect to the driving rotational body 10, so that the rotational phase is retarded and the valve timing is retarded and adjusted.

(Stopper Structure)

Subsequently, a stopper structure 60 provided in the phase adjustment system 8 will be described in detail.

As shown in FIG. 3, the stopper structure 60 is constructed by combining a stopper groove 62 of the gear member 11 and a stopper protrusion 64 of the driven rotational body 20 in the driving rotational body 10.

The stopper groove 62 is formed in an arcuate groove shape that opens to the inner circumferential side of the gear member 11 and extends along the circumferential direction. The inner end face of the stopper groove 62 in the advanced-angle direction Da forms a driving-side advanced-angle stopper wall 62*a*. The inner end face of the stopper groove 62 in the retarded-angle direction Dr forms a driving-side retarded-angle stopper wall 62*r*.

The stopper protrusion 64 is formed in a substantially fan shape protruding toward the outer circumference side of the driven rotational body 20. The stopper protrusion 64 is swingable to circumferentially one side and another side in the state where the stopper protrusion 64 protrudes in the stopper groove 62. The side surface of the stopper protrusion 64 in the advanced-angle direction Da forms a driven-side advanced-angle stopper wall 64*a*. The side surface of the stopper protrusion 64 in the retarded-angle direction Dr forms a driven-side retarded-angle stopper wall 64*r*.

As indicated by a two-dot chain line in FIG. 3, the driven rotational body 20 brings the driven-side advanced-angle stopper wall 64*a* into face-contact with the driving-side advanced-angle stopper wall 62*a* in the advanced-angle direction Da, so that the driven rotational body 20 is enabled to stop the relative rotation to the driving rotational body 10 in the same direction Da. At this time, the change in rotational phase is regulated at the most advanced-angle phase that is the phase end in the advanced-angle direction Da. Therefore, the driven rotational body 20 rotates relative to the driving rotational body 10 in the advanced-angle direction Da by the motor torque, and the driven-side advanced-angle stopper wall 64*a* collides against the driving-side advanced-angle stopper wall 62*a* to cause the collision torque.

On the other hand, as indicated by a solid line in FIG. 3, the driven rotational body 20 brings the driven-side retarded-angle stopper wall 64*r* into face-contact with the driving-side retarded-angle stopper wall 62*r* in the retarded-angle direction Dr, so that the driven rotational body 20 is enabled to stop the relative rotation to the driving rotational body 10 in the same direction Dr. At this time, the change in rotational phase is regulated at the most retarded-angle phase which is the phase end in the retarded-angle direction Dr. Therefore, the driven rotational body 20 rotates relative to the driving rotational body 10 in the retarded-angle direction Dr by the motor torque, and the driven-side retarded-angle stopper wall 64*r* collides against the driving-side retarded-angle stopper wall 62*r* to cause the collision torque.

Figure 6:
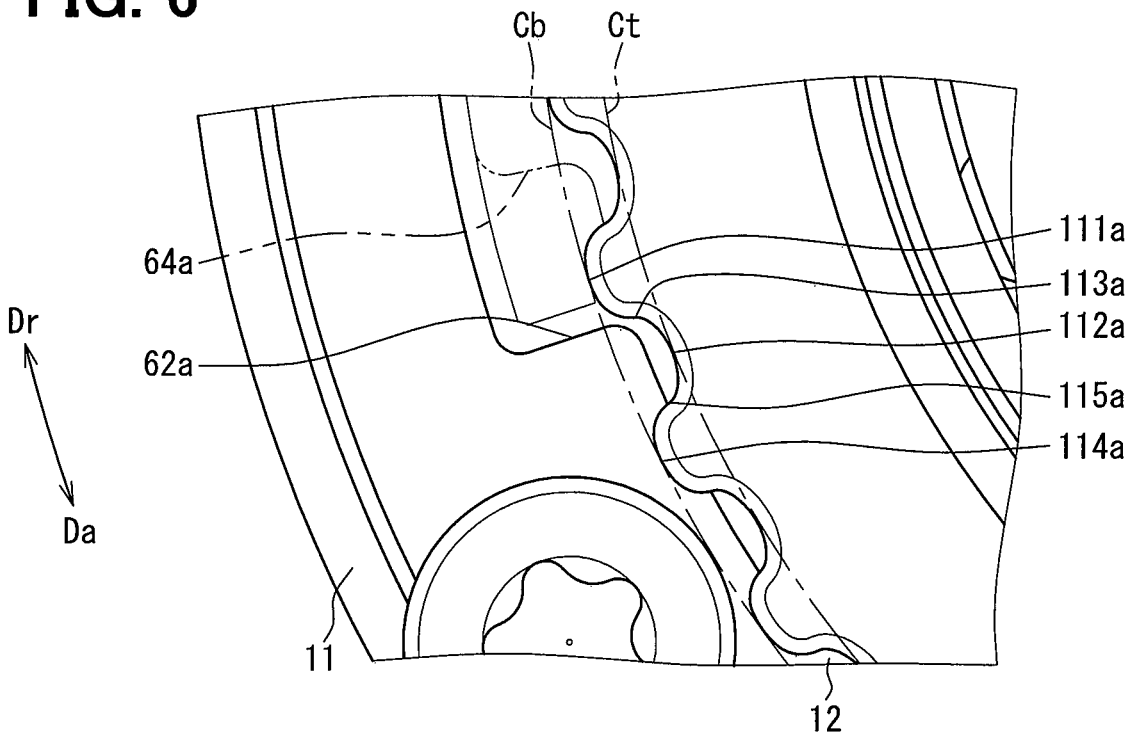
FIG. 6 is an enlarged front view showing a part of the gear member according to the first embodiment.

As shown in FIG. 6, the advanced-angle direction Da of the present embodiment coincides with the approaching direction in which the driven-side advanced-angle stopper wall 64*a* approaches the driving-side advanced-angle stopper wall 62*a*. In the advanced-angle direction Da as the approaching direction, a driving-side advanced-angle stopper wall 62*a* is formed between a specific tooth bottom 111*a* of the driving-side internal gear portion 12 in the gear member 11 and a specific tooth top 112*a* of the driving-side internal gear portion 12 located on the far side from the specific tooth bottom 111*a*.

Herein, in particular, the driving-side advanced-angle stopper wall 62*a* continues in a radial range extending from the outer circumference side of a tooth bottom circle Cb passing through the specific tooth bottom 111*a* to a portion between a tooth top circle Ct passing through the specific tooth top 112*a* and the tooth bottom circle Cb. In the advanced-angle direction Da, the driving-side advanced-angle stopper wall 62*a* continues in a circumstantial range extending from a position apart from a tooth surface 113*a* between the specific tooth bottom 111*a* and the specific tooth top 112*a* to a tooth surface 115*a* between the specific tooth top 112*a* and a tooth bottom 114*a* on the far side therefrom. In addition, the driving-side advanced-angle stopper wall 62*a* is axially connected to the driving-side internal gear portion 12.

With such a configuration, in the advanced-angle direction Da, it is possible to ensure a large thickness of the driving-side advanced-angle stopper wall 62*a* in a section from a portion between the specific tooth bottom 111*a* and the specific tooth top 112*a* to the tooth bottom 114*a* on the far side from the specific tooth top 112*a*.

Figure 7:
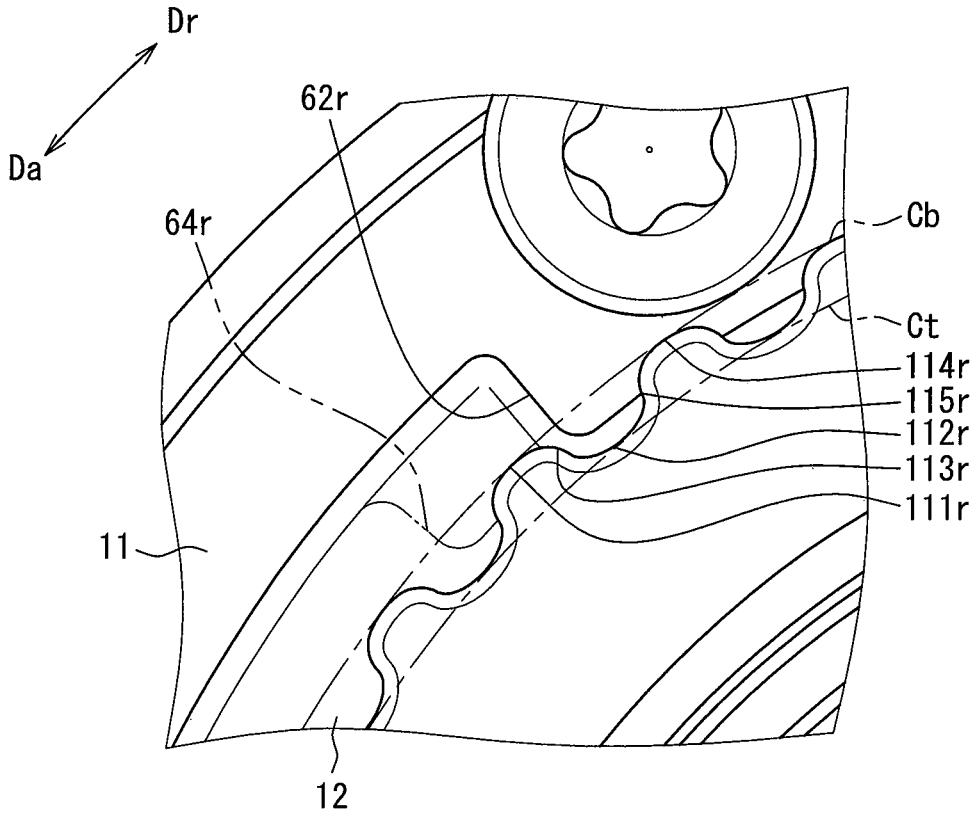
FIG. 7 is an enlarged front view showing another part of the gear member according to the first embodiment.

On the other hand, as shown in FIG. 7, the retarded-angle direction Dr of the present embodiment coincides with the approaching direction in which the driven-side retarded-angle stopper wall 64*r* approaches the driving-side retarded-angle stopper wall 62*r*. In the retarded-angle direction Dr as the approaching direction, the driving-side retarded-angle stopper wall 62*r* is formed between a specific tooth bottom 111*r* of the driving-side internal gear portion 12 of the gear member 11 and a specific tooth top 112*r* of the driving-side internal gear portion 12 located on the far side from the specific tooth bottom 111*r*.

Herein, in particular, the driving-side retarded-angle stopper wall 62*r* continues in a radial range extending from the outer circumference side of the tooth bottom circle Cb passing through the specific tooth bottom 111*r* to a portion between the tooth top circle Ct passing through the specific tooth top 112*r* and the tooth bottom circle Cb. In the retarded-angle direction Dr, the driving-side retarded-angle stopper wall 62*r* continues in a circumstantial range extending from a position apart from a tooth surface 113*r* between the specific tooth bottom 111*r* and the specific tooth top 112*r* to a tooth surface 115*r* between the specific tooth top 112*r* and a tooth bottom 114*r* on the far side therefrom. In addition, the driving-side retarded-angle stopper wall 62*r* is axially connected to the driving-side internal gear portion 12.

With such a configuration, in the retarded-angle direction Dr, it is possible to ensure a large thickness of the driving-side retarded-angle stopper wall 62*r* in a section from a portion between the specific tooth bottom 111*r* and the specific tooth top 112*r* to the tooth bottom 114*r* on the far side from the specific tooth top 112*r*.

From the above description, in the present embodiment, the driving-side advanced-angle stopper wall 62*a* and the driving-side retarded-angle stopper wall 62*r* correspond to the "driving-side stopper wall". Along with this, in the present embodiment, the driven-side advanced-angle stopper wall 64*a* and the driven-side retarded-angle stopper wall 64*r* correspond to the "driven-side stopper wall".

(Operations and Effects)

Hereinafter, operations and effects of the first embodiment described above will be described.

The gear member 11 meshed with the planetary gear 50 in the driving rotational body 10 according to the first embodiment has the driving-side advanced-angle stopper wall 62*a* and the driving-side retarded-angle stopper wall 62*r*. Therefore, collision torque caused by the driven-side advanced-angle stopper wall 64*a* of the driven rotational body 20 colliding against the driving-side advanced-angle stopper wall 62*a* of the gear member 11 is transmitted from the driven rotational body 20 to the planetary gear 50, and further transmitted from the planetary gear 50 to the gear member 11. The collision torque transmitted to the gear member 11 in this manner is received by the driven-side advanced-angle stopper wall 64*a* in contact with the driving-side advanced-angle stopper wall 62*a*, so that transmission between the gear member 11 and the cover member 13 can be restricted. Similarly, collision torque caused by the driven-side retarded-angle stopper wall 64*r* of the driven rotational body 20 colliding against the driving-side retarded-angle stopper wall 62*r* of the gear member 11 is transmitted from the driven rotational body 20 to the planetary gear 50, and further transmitted from the planetary gear 50 to the gear member 11. The collision torque transmitted to the gear member 11 in this manner is received by the driven-side retarded-angle stopper wall 64*r* in contact with the driving-side retarded-angle stopper wall 62*r*, so that transmission between the gear member 11 and the cover member 13 can be restricted.

As a result, the action of the relative torque caused by the collision torque can be suppressed between the gear member 11 and the cover member 13 fastened by the plurality of fastening members 15, and each fastening member 15 is thus unlikely to be loosened depending on the collision torque. Hence, it is possible to enhance durability and quietness by avoiding wear and abnormal noise from being generated at the meshing portion of the gear member 11 inclined due to looseness of each fastening member 15 with the planetary gear 50.

Further, according to the first embodiment, between the gear member 11 axially fastened by a plurality of screws being the fastening members 15 eccentric from the rotational center line O of the driving rotational body 10 and the cover member 13, the action of the relative torque caused due to the collision torque can be suppressed by the above principle. It is thereby possible to inhibit occurrence of an arc sliding phenomenon on the bearing surface 151*a* of each screw in contact with the gear member 11, and the screws is thus unlikely to be loosened. Hence, it is possible to ensure durability and quietness by avoiding wear and abnormal noise from being generated at the meshing portion of the gear member 11 inclined due to looseness of the screws with the planetary gear 50.

Moreover according to the first embodiment, in the relative rotational direction of the driven rotational body 20 with respect to the driving rotational body 10, the advanced-angle direction Da coincides with the approaching direction in which the driven-side advanced-angle stopper wall 64*a* approaches the driving-side advanced-angle stopper wall 62*a*. In the advanced-angle direction Da as the approaching direction, the driving-side advanced-angle stopper wall 62*a* is formed between the specific tooth bottom 111*a* in the gear member 11 and the specific tooth top 112*a* located on the far side from the specific tooth bottom 111*a*. Accordingly, in the advanced-angle direction Da, it is possible to ensure a large thickness of the driving-side advanced-angle stopper wall 62*a* in a section from the portion between the specific tooth bottom 111*a* and the specific tooth top 112*a* to the tooth bottom 114*a* on the far side from the specific tooth top 112*a*. Therefore, breakage of the driving-side advanced-angle stopper wall 62*a* caused by the collision torque can be inhibited to ensure high durability.

In addition, according to the first embodiment, in the relative rotational direction of the driven rotational body 20 with respect to the driving rotational body 10, the retarded-angle direction Dr coincides with the approaching direction in which the driven-side retarded-angle stopper wall 64*r* approaches the driving-side retarded-angle stopper wall 62*r*. In the retarded-angle direction Dr as the approaching direction, the driving-side retarded-angle stopper wall 62*r* is formed between the specific tooth bottom 111*r* in the gear member 11 and the specific tooth top 112*r* located on the far side from the specific tooth bottom 111*r*. Accordingly, in the retarded-angle direction Dr, it is possible to ensure a large thickness of the driving-side retarded-angle stopper wall 62*r* in a section from the portion between the specific tooth bottom 111*r* and the specific tooth top 112*r* to the tooth bottom 114*r* on the far side from the specific tooth top 112*r*. Therefore, breakage of the driving-side retarded-angle stopper wall 62*r* caused by the collision torque can be inhibited to ensure high durability.

Second Embodiment

As shown in FIGS. 8 to 12, a second embodiment of the present disclosure is a modification of the first embodiment. A driving rotational body 2010 of the second embodiment includes a gear member 2011, a cover member 2013, and a plurality of fastening members 2015 that coaxially fasten the two members 2011, 2013 in a configuration differently from that of the first embodiment.

Figure 8:
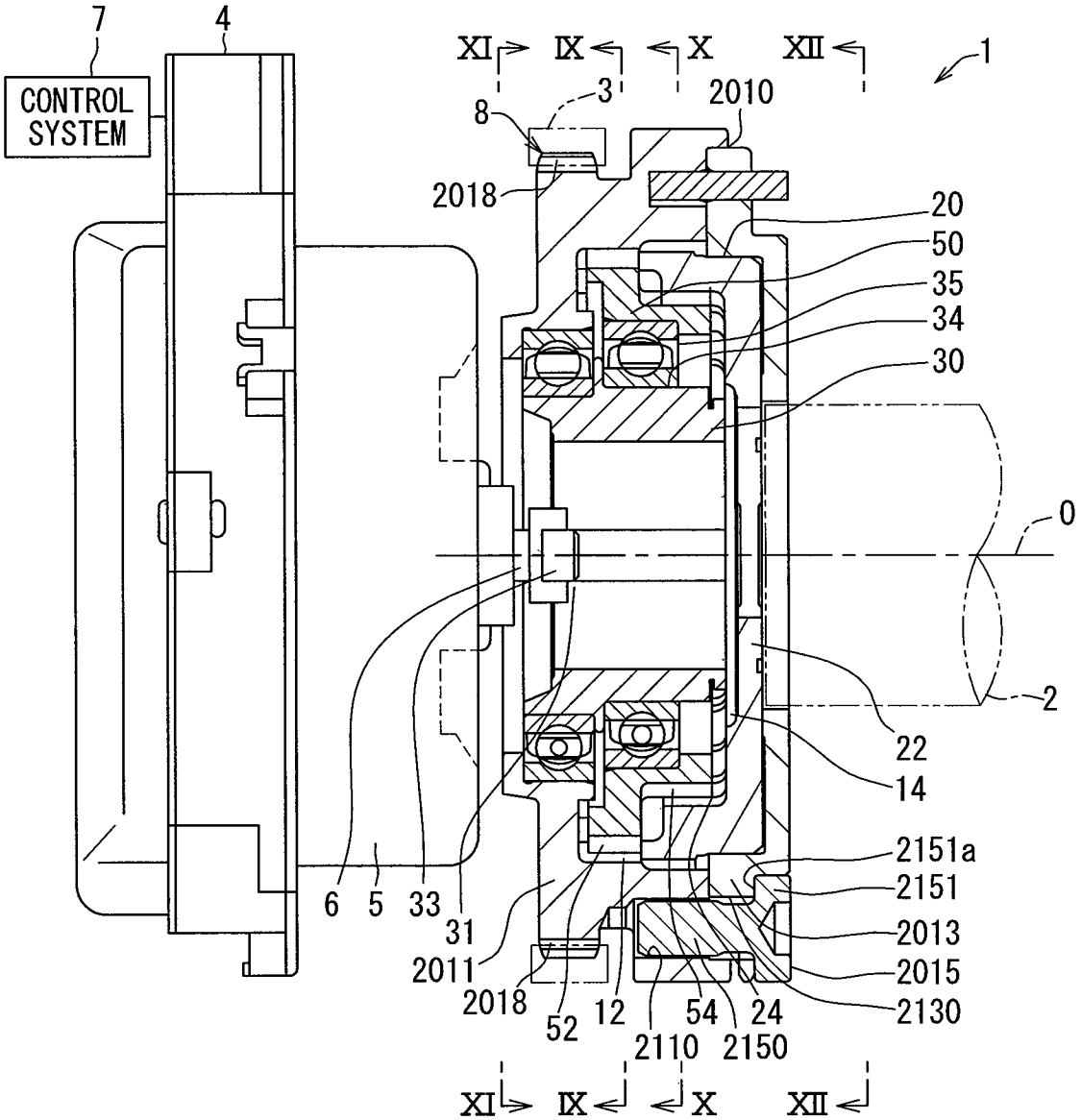
FIG. 8 is a view showing a valve timing adjustment device according to a second embodiment, FIG. 8 being a sectional view taken along a line VIII-VIII in FIG. 9.
Figure 9:
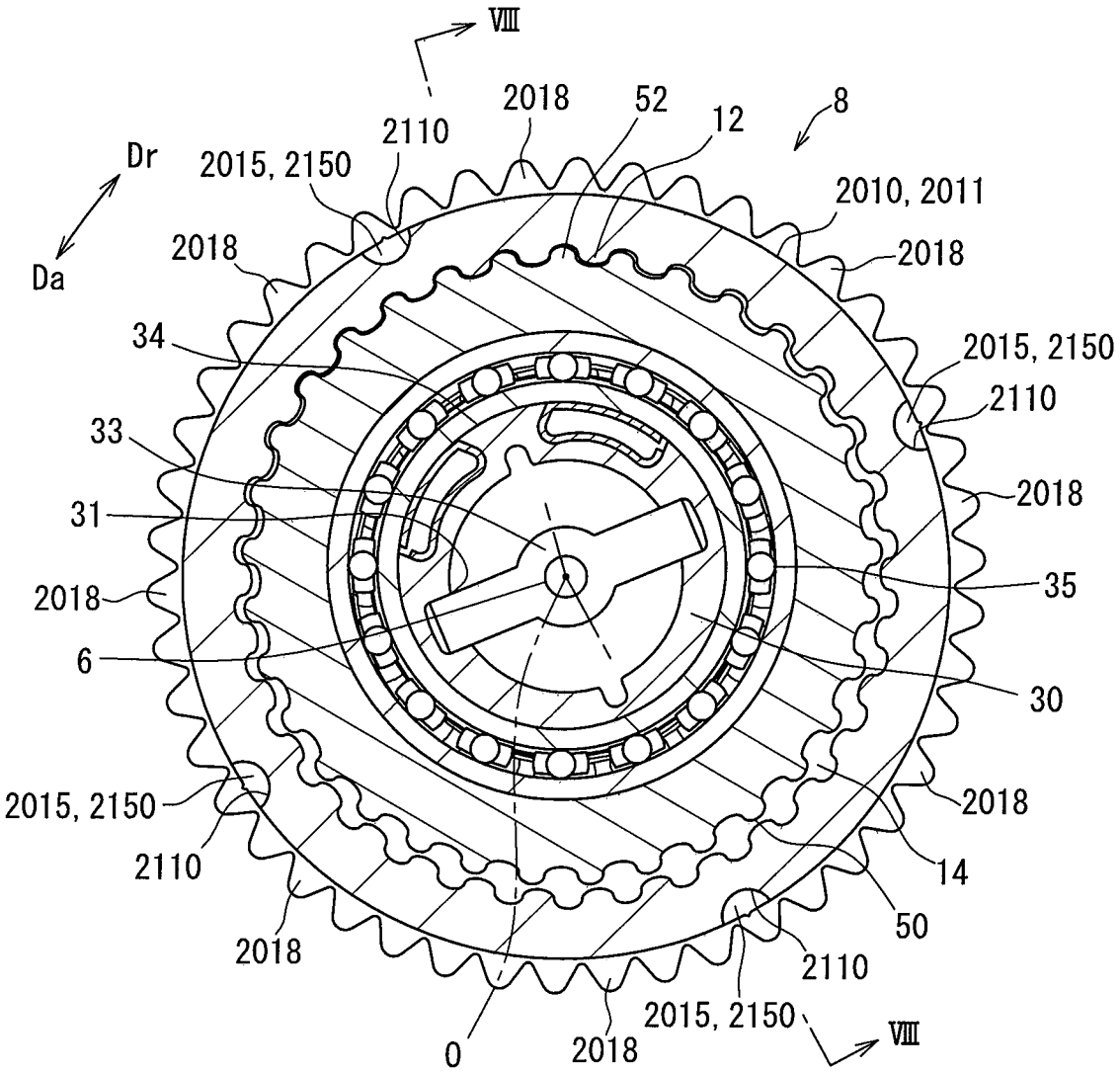
FIG. 9 is a sectional view taken along a line IX-IX in FIG. 8.
Figure 10:
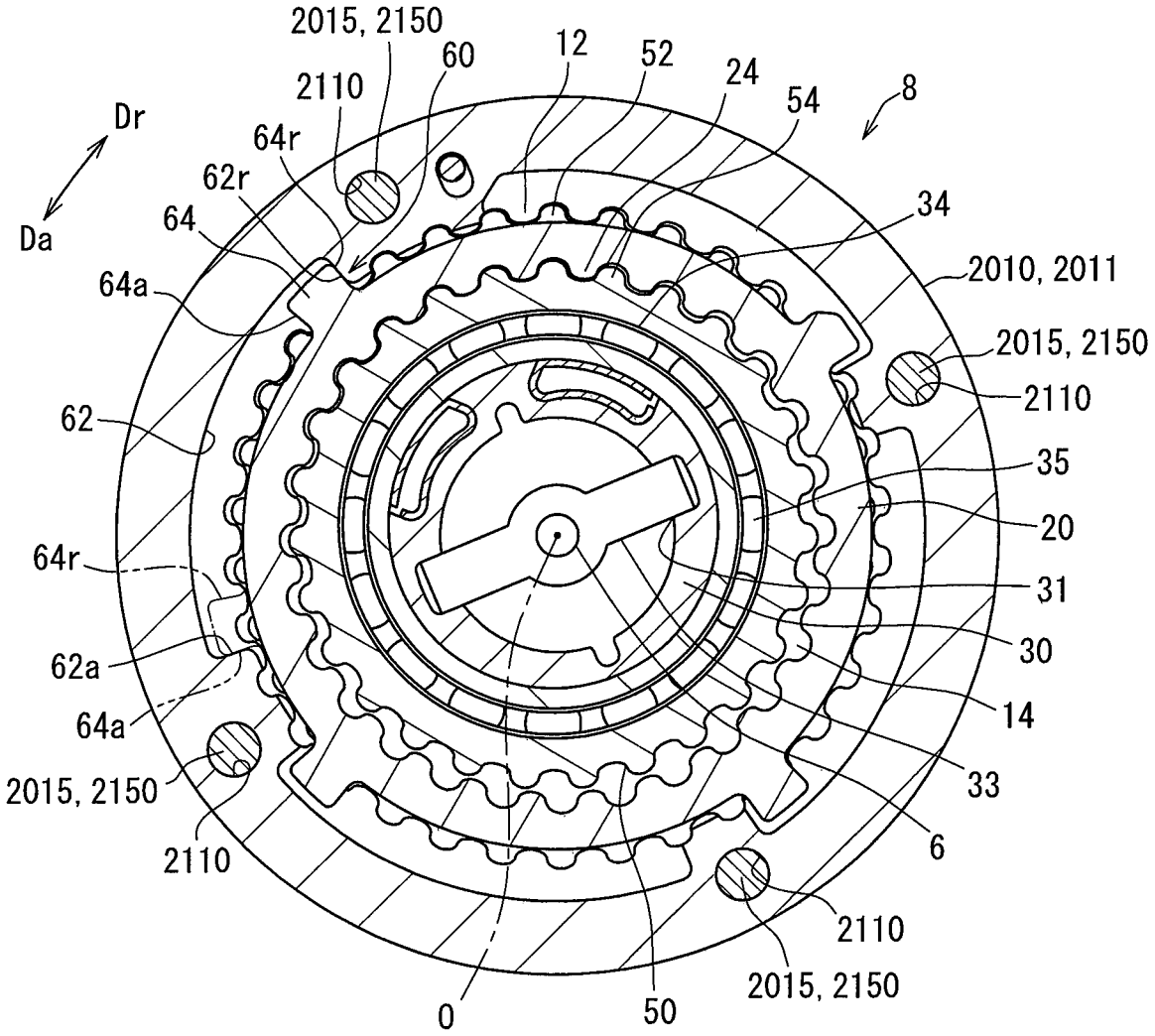
FIG. 10 is a sectional view taken along a line X-X in FIG. 8.
Figure 11:
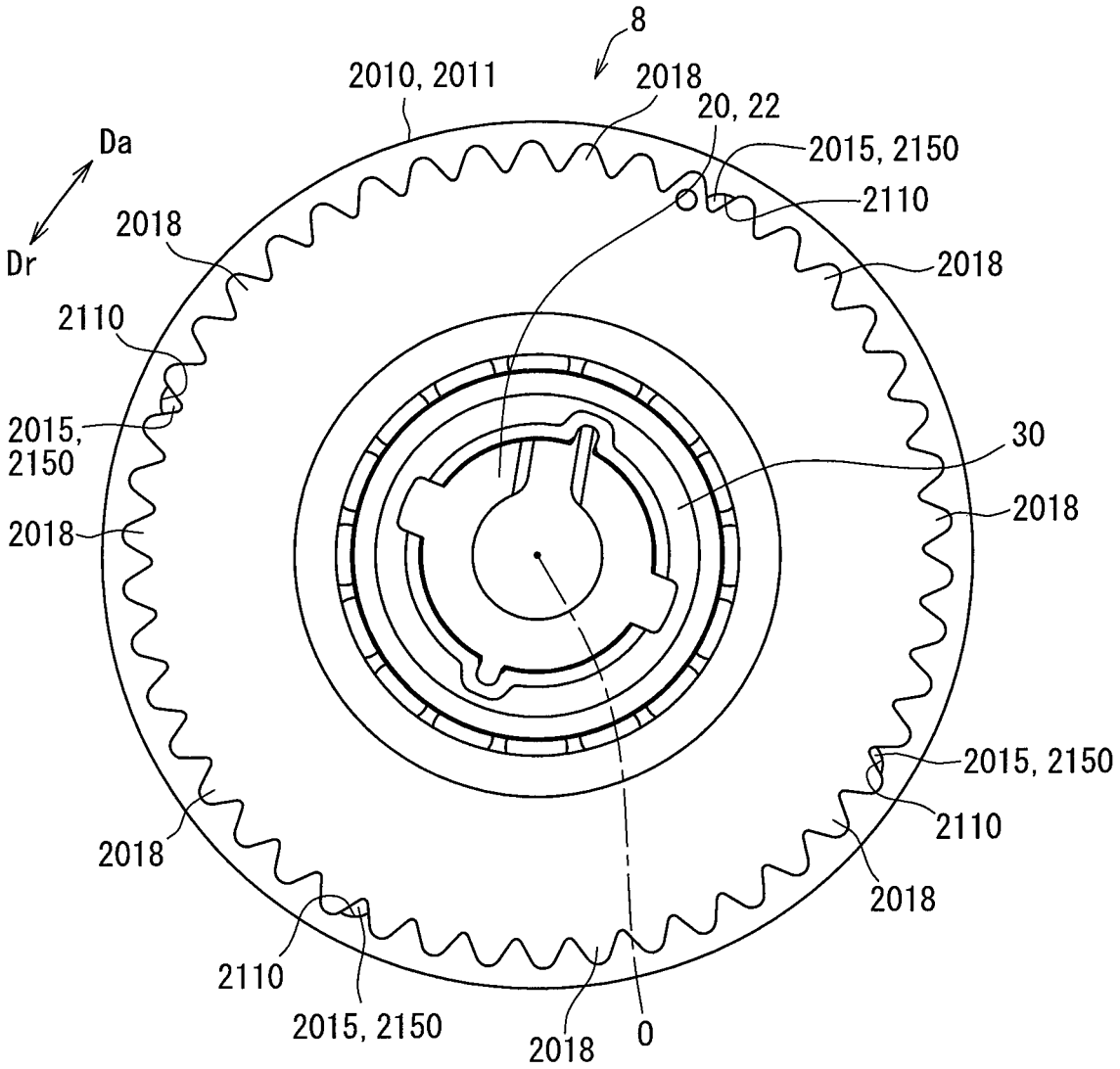
FIG. 11 is an arrow view taken along a line XI-XI in FIG. 8.
Figure 12:
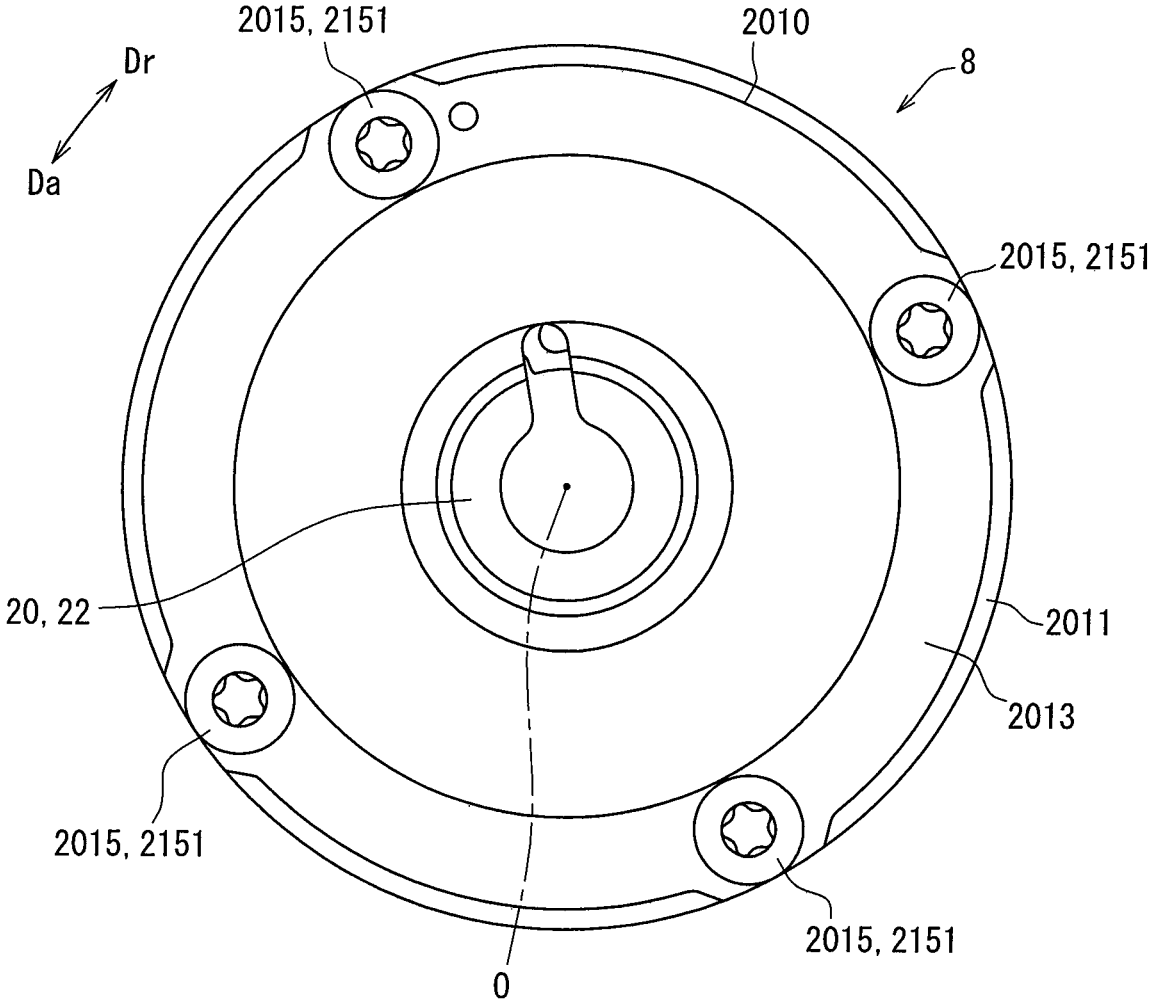
FIG. 12 is an arrow view taken along a line XII-XII in FIG. 8.
Figure 13:
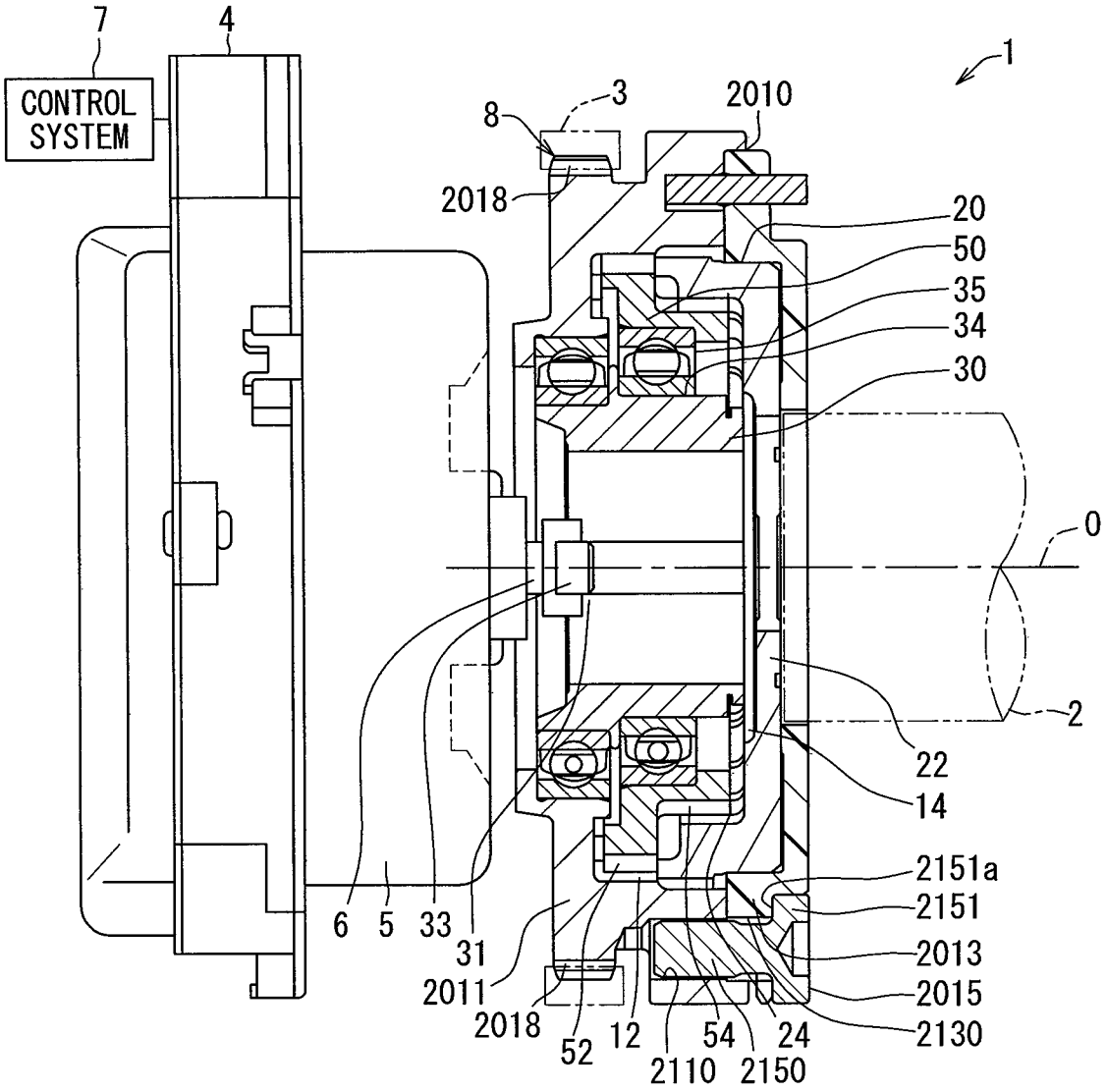
FIG. 13 is a sectional view showing a modification of FIG. 8.
Figure 14:
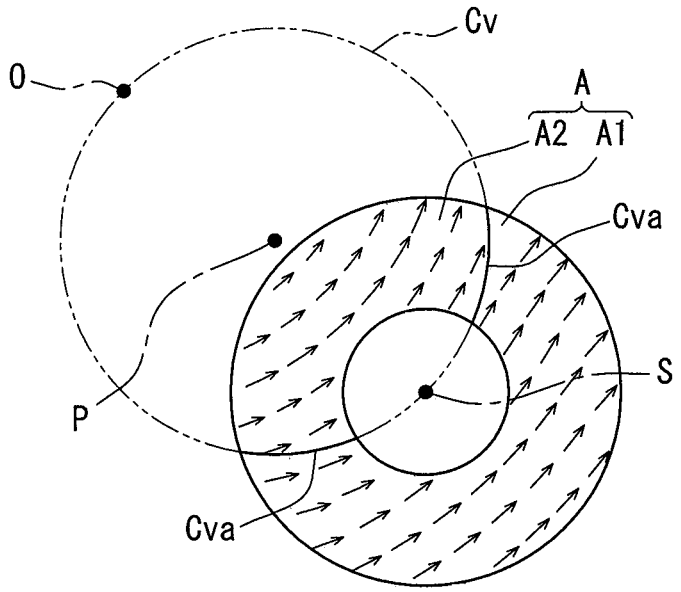
FIG. 14 is a schematic diagram for explaining a conventional issue.

Specifically, as shown in FIGS. 8 and 13, a plurality of sprocket teeth 18 are not provided in the cover member 2013 made of metal. Instead, as shown in FIGS. 8, 9, and 11, the gear member 2011 made of metal is provided with a plurality of sprocket teeth 2018 together with the driving-side internal gear portion 12. Herein, the sprocket tooth 2018 protrudes outward from positions circumferentially spaced at regular intervals in the gear member 2011. The gear member 2011 is linked to the crankshaft by the transmission member 3 bridging between the sprocket teeth 2018 and the plurality of teeth of the crankshaft. Under such a linked state, the crank torque of the crankshaft is transmitted to the gear member 2011 through the transmission member 3, whereby the driving rotational body 2010 rotates around the rotational center line O in conjunction with the crankshaft. Herein, the rotational direction of the driving rotational body 2010 is circumferentially one side (i.e., counterclockwise direction in FIGS. 9 and 10) which is the same as in the first embodiment.

As shown in FIGS. 8 to 12, each fastening member 2015 is located so as to be axially shifted from a forming position of the sprocket teeth 2018 to the camshaft 2 side in the driving rotational body 2010. Each fastening member 2015 is integrally provided with a male screw portion 2150 and a head 2151 that are different from those of the first embodiment. Herein, the male screw portion 2150 is loosely inserted in a through hole 2130 axially extending through the cover member 2013 on the axially opposite side from the electric motor 4 across the gear member 2011. The male screw portion 2150 is further screwed into a female screw hole 2110 axially extending through the gear member 2011. A bearing surface 2151*a* shown in FIG. 8 is formed on the head 2151 so as to sandwich the cover member 2013 with the gear member 2011 screwed with the male screw portion 2150.

The second embodiment is the same as the first embodiment except for the configuration described above. Thus, hereinafter, description of operation and effect which are similar to those of the first embodiment among the operations and effects of the second embodiment is omitted, and the operations and effect to be added to the first embodiment will be described.

Crank torque is transmitted from the crankshaft to the gear member 2011 meshed with the planetary gear 50 in the driving rotational body 10 according to the second embodiment. As a result, the crank torque is transmitted from the gear member 2011 to the planetary gear 50, and further sequentially transmitted from the planetary gear 50 to the driven rotational body 20 and the camshaft 2, thereby causing the camshaft 2 to open and close the intake valve. At this time, the action of the relative torque due to the crank torque can be suppressed between the gear member 2011 and the cover member 2013 axially fastened by the fastening members 2015, and each fastening member 2015 is thus unlikely to be loosened depending on the crank torque. Along with this, the action of the relative torque caused by the collision torque can be suppressed by the same principle as that of the first embodiment between the gear member 2011 and the cover member 2013, and each fastening member 2015 is thus unlikely to be loosened depending on the collision torque. From the above description, it is possible to enhance the function of avoiding wear and abnormal noise from being generated at the meshing portion of the gear member 2011 inclined due to the looseness of each of the fastening member 2015 with the planetary gear 50, and thus it is possible to enhance the reliability of the durability and quietness ensuring effect.

OTHER EMBODIMENTS

Although the embodiments of the present disclosure have been described above, the present disclosure is not to be construed as being limited to only those embodiments, and is applicable to various embodiments and combinations within a scope not departing from the gist of the present disclosure.

In a first modification of the first and second embodiments, the cover member 13, 2013 may be located on the side opposite from the camshaft 2 with the gear member 11, 2011 axially interposed therebetween. As a second modification relating to the second embodiment, as shown in FIG. 13, the cover member 2013 may be formed of resin. Herein, in the second modification, the action of the relative torque caused due to the crank torque and the collision torque can be suppressed between the gear member 2011 and the cover member 2013, and hence the second modification can be adopted depending on reduction in strength required for the cover member 2013.

In an advanced-angle direction Da as a third modification concerning the first and second embodiments, the driving-side advanced-angle stopper wall 62*a* is formed in a position deviated from a portion between the specific tooth bottom 111*a* and the specific tooth top 112*a* on the far side therefrom. In a retarded-angle direction Dr as a fourth modification relating to the first and second embodiments, the driving-side retarded-angle stopper wall 62*r* is formed in a position deviated from a portion between the specific tooth bottom 111*r* and the specific tooth top 112*r* on the far side therefrom.

In a fifth modification relating to the first and second embodiments, the plurality of fastening members 15, 2015 may be circumferentially located at irregular intervals. In a sixth modification relating to the first and second embodiments, the fastening members 15, 2015 may be rivets or the like other than the screws.

As a seventh modification relating to the first and second embodiments, an output shaft of, for example, an electromagnetic brake other than the electric motor 4 may be coupled to the input portion 31 of the planetary carrier 30. As an eighth modification relating to the first and second embodiments, the present disclosure may be applied to a device that adjusts the valve timing of an exhaust valve as the movable valve of the internal combustion engine.

The valve timing adjustment device 1 according to the first disclosure described above adjusts the valve timing of the movable valve which is opened and closed with the camshaft 2 by transmission of a crank torque from the crankshaft in the internal combustion engine. The valve timing adjustment device 1 includes the driving rotational body 10, 2010, the driven rotational body 20, and the planetary gear 50. The driving rotational body 10, 2010 includes the driving-side stopper walls 62*a*, 62*r*, and rotates in conjunction with the crankshaft. The driven rotational body 20 includes the driven-side stopper walls 64*a*, 64*r*. As the driven rotational body 20 rotates in conjunction with the camshaft and rotates relative to the driving rotational body, the rotational phase between the driven rotational body 20 and the driving rotational body changes. The driven rotational body 20 brings the driven-side stopper wall and the driving-side stopper wall into contact with each other in the relative rotational direction Da, Dr to the driving rotational body to regulate the change in the rotational phase. The planetary gear 50 performs a planetary motion while being meshed with the driving rotational body and the driven rotational body to change the rotational phase. The driving rotational body includes the gear member 11, 2011, the cover member 13, 2013, and a fastening member 15, 2015. The gear member 11, 2011 forms a driving-side stopper wall and is meshed with the planetary gear. The cover member 13, 2013 covers the accommodation space 14 in which the driven rotational body and the planetary gear are accommodated, in cooperation with the gear member. The fastening member 15, 2015 axially fastens the gear member and the cover member.

In the driving rotational body according to the first disclosure, the gear member meshed with the planetary gear forms the driving-side stopper wall. Therefore, collision torque caused by the driven-side stopper wall of the driven rotational body colliding against the driving-side stopper wall of the gear member is transmitted from the driven rotational body to the planetary gear, and further transmitted from the planetary gear to the gear member. The collision torque transmitted to the gear member in this manner is received by the driven-side stopper wall, which is in contact with the driving-side stopper wall, so that the transmission between the gear member and the cover member can be suppressed. As a result, the action of the relative torque caused by the collision torque can be suppressed between the gear member and the cover member axially fastened by the fastening members, and each fastening member is thus unlikely to be loosened depending on the collision torque. Hence, it is possible to ensure durability and quietness by avoiding wear and abnormal noise from being generated at the meshing portion of the gear member inclined due to looseness of the fastening members with the planetary gear.

In addition, the fastening member according to the second disclosure is a screw that is located to be eccentric from the rotational center line O of the driving rotational body.

According to the second disclosure as thus described, between the gear member axially fastened by screws being the fastening members eccentric from the rotational center line of the driving rotational body and the cover member, the action of the relative torque caused due to the collision torque can be suppressed by the principle of the first disclosure. It is thereby possible to inhibit occurrence of an arc sliding phenomenon on the bearing surface of each screw in contact with the gear member 11, and the screws is thus unlikely to be loosened. Hence, it is possible to ensure durability and quietness by avoiding wear and abnormal noise from being generated at the meshing portion of the gear member inclined due to looseness of the screws with the planetary gear.

Although the present disclosure has been described in accordance with the embodiments, it is understood that the present disclosure is not limited to the embodiments and structures. The present disclosure encompasses various modifications and variations within an equivalent scope. In addition, various combinations and forms, as well as other combinations and forms including only one element, more than that, or less than that, are also within the scope and idea of the present disclosure.

The invention claimed is:

1. A valve timing adjustment device configured to adjust a valve timing of a movable valve, the movable valve configured to be opened and closed with a camshaft by transmission of a crank torque from a crankshaft in an internal combustion engine, the valve timing adjustment device comprising:

a driving rotational body including a driving-side stopper wall and configured to rotate in conjunction with the crankshaft;

a driven rotational body including a driven-side stopper wall, the driven rotational body configured to rotate relative to the driving rotational body while rotating in conjunction with the camshaft to change a rotational phase relative to the driving rotational body and to bring the driven-side stopper wall and the driving-side stopper wall into contact with each other in a relative rotational direction to the driving rotational body to regulate a change in the rotational phase; and a planetary gear configured to perform a planetary motion while being meshed with the driving rotational body and the driven rotational body to change the rotational phase, wherein the driving rotational body includes a gear member having the driving-side stopper wall and having a gear portion meshed with the planetary gear, a cover member covering an accommodation space, in which the driven rotational body and the planetary gear are accommodated, in cooperation with the gear member, and a fastening member axially fastening the gear member with the cover member, and the driven rotational body is configured to transmit a collision torque, which is caused when the driven-side stopper wall collides against the driving-side stopper wall, to the gear member, and to restrict transmission of the collision torque between the gear member and the cover member.

2. The valve timing adjustment device according to claim 1, wherein the fastening member is a screw located eccentrically from a rotational center line of the driving rotational body.

3. The valve timing adjustment device according to claim 1, wherein the driving rotational body is configured to rotate in conjunction with the crankshaft by transmission of the crank torque from the crankshaft to the gear member.

4. The valve timing adjustment device according to claim 1, wherein the driving-side stopper wall is formed between a specific tooth bottom of the gear member and a specific tooth top of the gear member, which is located on a far side from the specific tooth bottom, in an approaching direction in which the driven-side stopper wall is configured to approach the driving-side stopper wall in the relative rotational direction.

5. The valve timing adjustment device according to claim 1, wherein the driven rotational body is coaxially fitted to an inner circumferential side of the cover member.

* * * * *